United States Patent [19]

Cannone

[11] 4,406,040

[45] Sep. 27, 1983

[54] ILLUMINATION DEVICES

[76] Inventor: Robert P. Cannone, P.O. Box 3717, Soldotna, Ak. 99669

[21] Appl. No.: 963,749

[22] Filed: Nov. 27, 1978

[51] Int. Cl.[3] ..... A44B 21/00

[52] U.S. Cl. ..... 24/3 J; 224/250; 224/269; 362/106; 362/396; 403/97

[58] Field of Search ..... 224/162, 181, 197, 200, 224/250, 252, 267, 269, 271, 270, 182; 362/105, 106, 103, 191, 200, 201, 233, 396, 382; 24/3 L, 81 AD, 81 AY, 3 J, 3 R; 220/96; 403/97; 248/359, 360, 291, 293

[56] References Cited

U.S. PATENT DOCUMENTS

| | | | |
|---|---|---|---|
| D. 203,101 | 12/1965 | Holder | 224/252 |
| 315,178 | 4/1885 | Souter | 24/3 J |
| 1,318,850 | 10/1919 | Yong | 224/252 |
| 1,913,142 | 6/1933 | Ondricek | 224/269 |
| 2,421,643 | 6/1947 | Ostli | 362/106 |
| 2,509,428 | 5/1950 | Green | 224/252 |
| 2,524,881 | 10/1950 | Chambers | 362/106 |
| 2,585,592 | 2/1952 | Sears | 224/181 |
| 3,346,153 | 10/1967 | Galasso | 224/181 |
| 4,006,851 | 2/1977 | Kippen | 224/197 |

*Primary Examiner*—Kenneth W. Noland

[57] ABSTRACT

This invention is related to illumination devices and more particularly to flashlights and flashlight holding implements. A flashlight holding implement and flashlight is attached to a hat brim and enables the user to direct and adjust the angular position of the light beam, and eliminate the need for the user to hand-hold the flashlight while performing the task before him.

2 Claims, 10 Drawing Figures

ILLUMINATION DEVICES

This invention relates to illumination devices and more specifically to flashlights and flashlight holders. It has a primary objective to provide a flashlight and flashlight holder which attaches to a hat brim enabling the user the use of both hands in performing the task before him.

Another objective of this invention is to provide a flashlight adapted with a clip and a flashlight supporting clip both of which contain a hinge type mechanism enabling the use to select the angular position of the light beam.

Other objects and attendant advantages of this invention will become more readily apparent and understood from the following detailed specifications and accompanying drawings in which.

Figure 8:
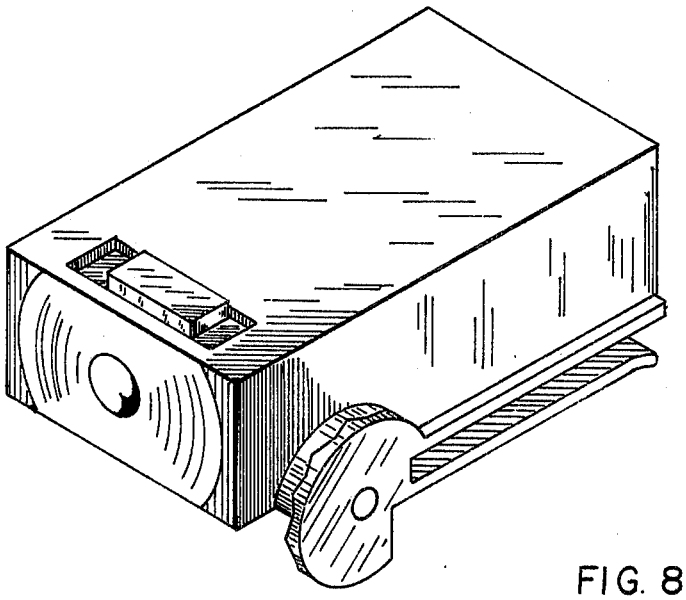
Figure 9:
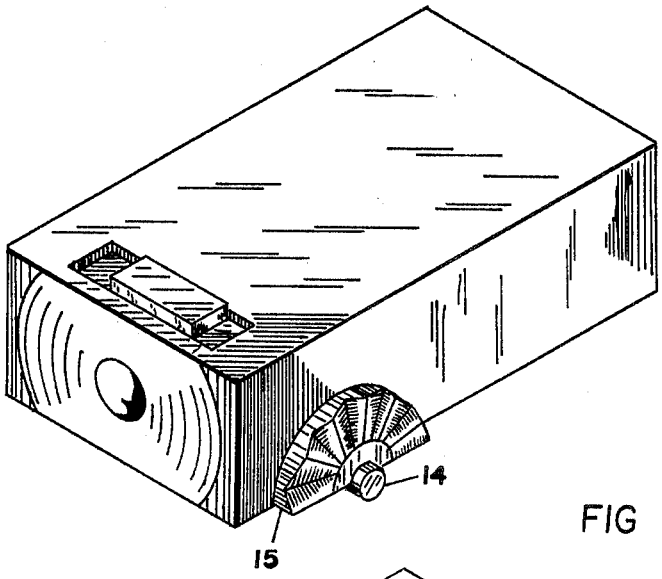
Figure 10:
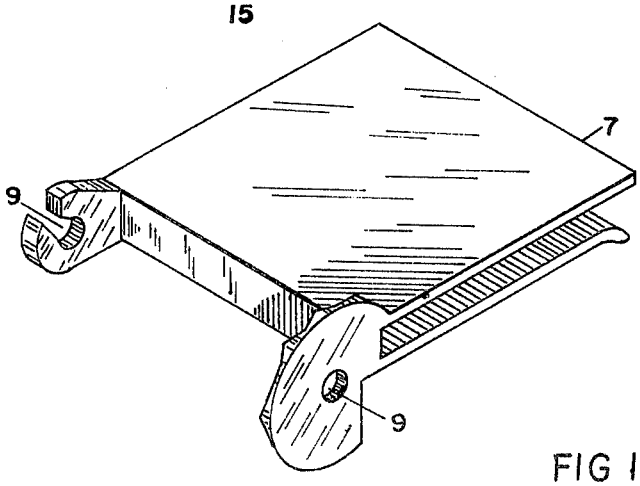

FIG. 8, FIG. 9, and FIG. 10 together illustrate how the invention can be modified by incorporating the base plate and adjustment mechanism into the design of a flashlight.

Referring now to the drawings in more detail, the hat brim attachment mechanism (1) consists of metal, wood, plastic or other material so shaped as to form a clip which tightly embraces a hat brim. An expansible strap (2) is attached to clip (1) by riveting, welding, gluing, molding, or other means. A flashlight (f) is attached to the invention by inserting it under the expansible strap (2) such that the flashlight is held firmly in place on the clip.

Figure 1:
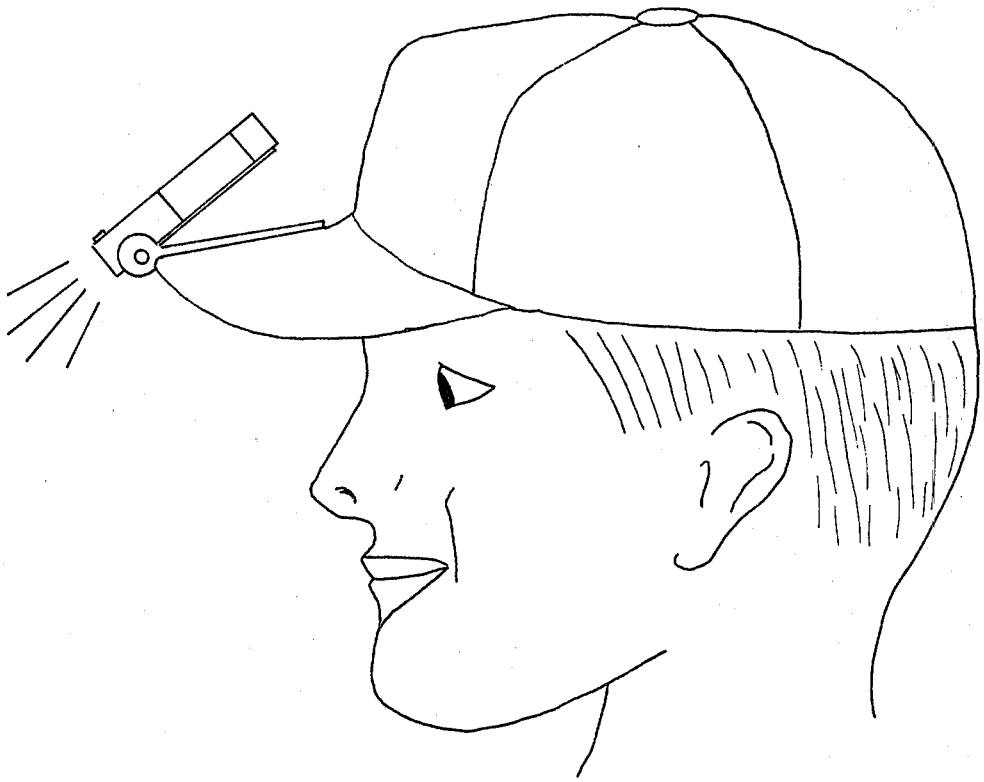
FIG. 1 is a side view depicting the use of this invention.
Figure 2:
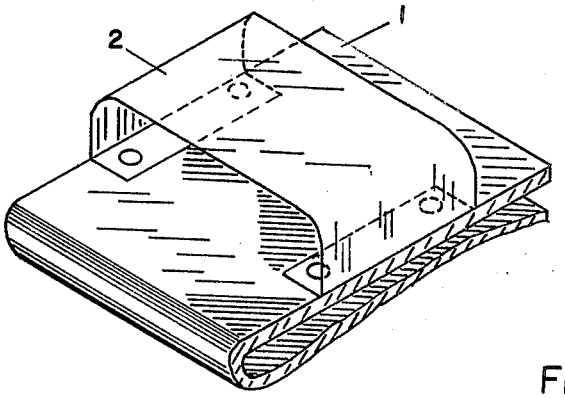
FIG. 2 is a view showing a nonadjustable holder without flashlight or hat brim.
Figure 3:
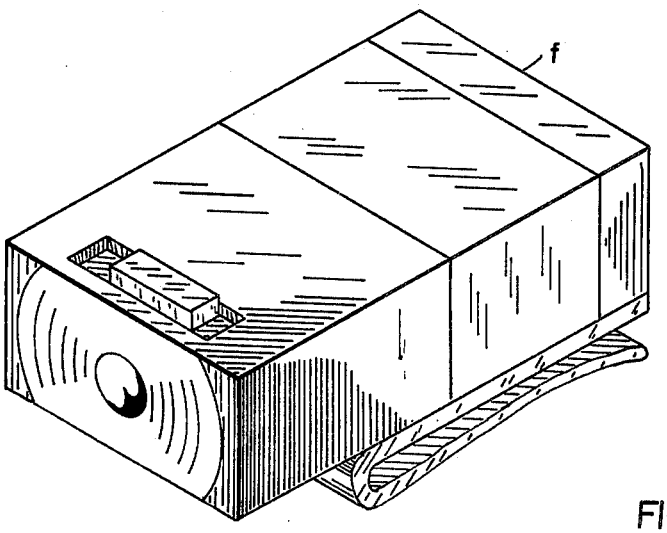
FIG. 3 is a view showing the flashlight attached to the invention.
Figure 4:
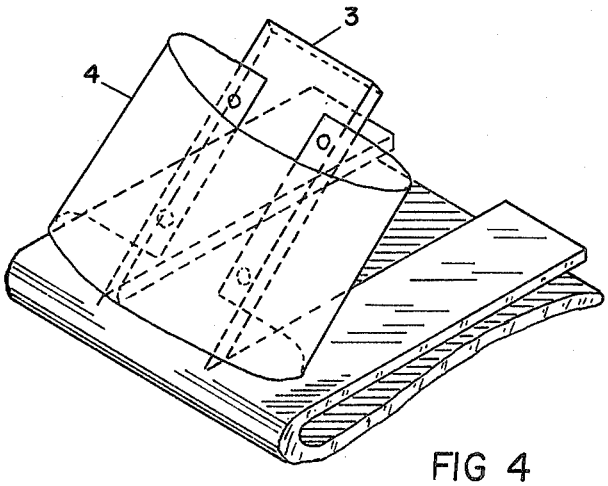
FIG. 4 and FIG. 5 are views showing adjustment mechanisms for this invention.

Referring to FIG. 4, a flashlight adjustment clip consists of metal, plastic or some other material shaped to form a clip which tightly embraces a hat brim and is provided with a flashlight adjustment tab (3) to which an expansible strap (4) is fastened by riveting, welding, molding, gluing or other means. Adjustment of the light beam is accomplished by bending tab (3) to a desired angular position.

Figure 5:
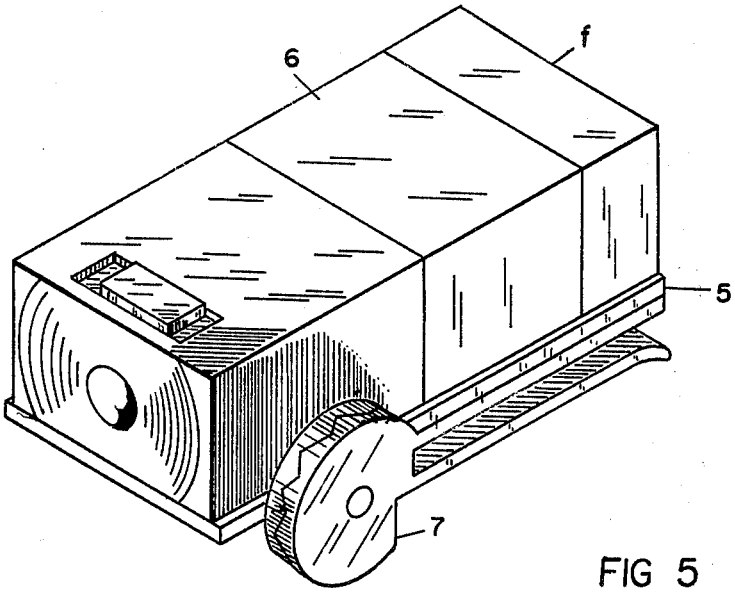
Figure 6:
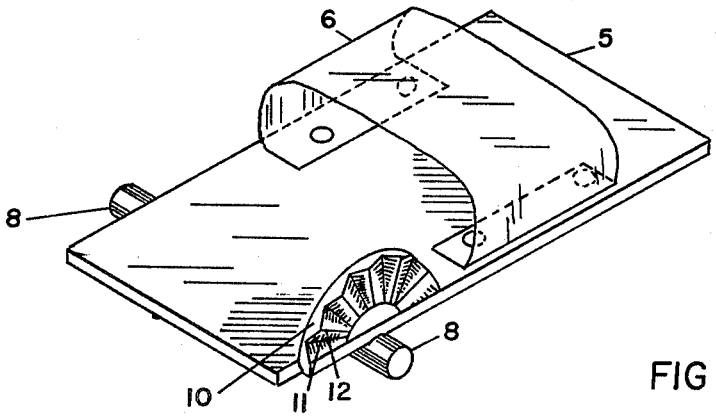
FIG. 6 shows the base plate on which the flashlight is attached and to which the brim clip attaches.
Figure 7:
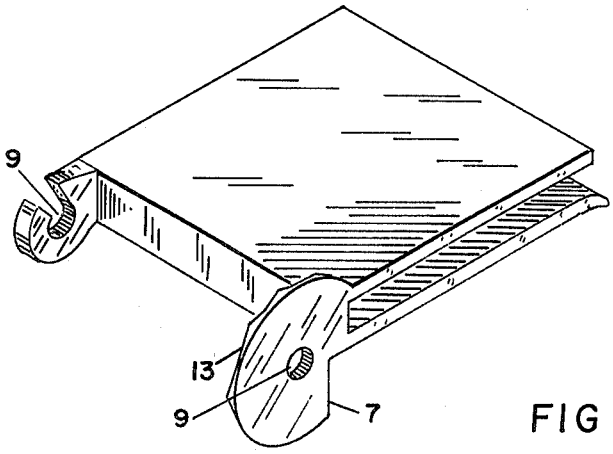
FIG. 7 shows the brim clip without base plate.

Referring to FIG. 5, a flashlight adjustment clip consists of a base plate (5) with expansible strap (6) and a mating hat clip (7). Base clip (5) is attached to hat clip (7) by means of inserting rods (8) into apertures (9). Base plate (5) consists of wood, plastic, metal, or other material. Base plate adjusting element (10) is affixed to base plate (5) in an upright position and contains a number of depressions (11) and elevations (12) which when mated to hat clip (7), containing an adjustment element (13) with depressions and elevations, interlock to hold the flashlight firmly in position. Adjustment of the light beam is accomplished by rotating base plate (5) about an axis formed by rods (8) and apertures (9).

Referring to FIG. 9, a flashlight is adapted with rods (14) and interlocking adjustment element (15) by gluing, molding or other means. The flashlight is attached to hat clip (7) (FIG. 10) by inserting rods (14) into apertures (9).

Obviously, many modifications and variations of the stated invention are possible in light of the above descriptions. It is therefore to be understood that within the scope of the appended claims the invention may be practiced otherwise than as specifically described.

What is claimed is:

1. A flashlight holding implement constructed so as to permit the attachment of a flashlight to a hat brim and allow the angular adjustment of the flashlight comprised of; a clip constructed of a resilient material, said clip having an elongated top portion and a reverse-bend and a bottom portion extending back to a length of the top portion and separated from said top portion at such distance as to permit the resiliency of the construction material to firmly clasp a hat brim between the slot formed by the top and bottom portions of the clip, said clip also comprised of two tabs extending beyond the reverse-bend of the clip and positioned perpendicular to the plane of said top portion, said tabs each containing an aperature positioned such that a single straight rod may be connected to each aperature with the axis of the rod parallel to the length of said reverse-bend, one of said tabs comprised of equally spaced ridges extending radially from the center of the aperature and protruding inward toward the other tab, the other of said tabs comprised of a slot to allow one end of said rod to be inserted therein, attached to said clip is an elongated plate comprised of said rod near the front end of said plate, said rod having an axis perpendicular to a main axis of the plate which is perpendicular to the planar portion of said plate and said rod having rod ends extending sufficiently beyond the plate to permit the plate to be held to previously said clip by inserting the rod ends into previously said aperatures, said plate also comprised of an expandable strap with which to fasten a flashlight, said expandable strap fixed to plate by gluing, riveting, or other means, said plate also comprised of a mating tab which co-operates with the previously said ridged tab on the clip, said mating tab positioned over the appropriate protruding rod end of said rod and comprised of ridges extending radially from the center of the appropriately protruding rod end and protruding outwardly from said plate, said plate fixed to said clip by inserting said rod ends into said aperatures and with the ridged tab on said plate mating with the ridged tab on said clip, said mating tabs forming an interlocking mechanism which permits the angular adjustment of said plate by rotating about the rod axis, such rotation permitted by the resiliency of the construction material.

2. A flashlight body with flashlight holding implement so constructed so as to permit the attachment of said flashlight body to a hat brim and allow the angular adjustment of said flashlight body comprised of; a clip constructed of a resilient material, said clip having an elongated top portion and a reverse-bend and a bottom portion extending back to a length of the top portion and separated from said top portion at such distance as to permit the resiliency of the construction material to firmly clasp a hat brim between the slot formed by the top and bottom portions of the clip, said clip also comprised of two tabs extending beyond the reverse-bend of the clip and positioned perpendicular to the plane of said top portion, said tabs each containing an aperature positioned such that a single straight rod may be connected to each aperature with the axis of the rod parallel to the length of said reverse-bend, one of said tabs comprised of equally spaced ridges extending radially fro the center of the aperature and protruding inward towards the other tab, the other of said tabs comprised of a slot to allow one end of said rod to be inserted therein, attached to said clip is a flashlight body of rectangular box or other shape containing conventional flashlight components, said flashlight body comprised of said rod located at the bottom and towards the front of the flashlight body, said rod positioned such that the axis of the rod is perpendicular to the length of the flashlight body, said flashlight body also comprised of mating ridges which co-operate with the previously said ridged tab on the clip, said mating ridges located on the flashlight body are positioned over the appropriate protruding rod end of said rod and extending radially from the center of the appropriately protruding rod end and protruding outward from the flashlight body, said flashlight body fixed to said clip by inserting said rod into said aperatures with the mating ridges on said flashlight body mating with the ridged tab on said clip, said mating ridges forming an interlocking mechanism which permits the angular adjustment of said flashlight body by rotating about the rod and aperature axis, such rotation permitted by the resiliency of the construction material.

* * * * *